US006705327B2

(12) United States Patent
Tilson

(10) Patent No.: US 6,705,327 B2
(45) Date of Patent: Mar. 16, 2004

(54) METHOD AND SYSTEM TO POLISH AND PROTECT NATURAL NAILS

(76) Inventor: Jan Beaver Tilson, 320 E. Wallace St., San Saba, TX (US) 76877

( * ) Notice: Subject to any disclaimer, the term of this patent is extended or adjusted under 35 U.S.C. 154(b) by 0 days.

(21) Appl. No.: 10/010,192

(22) Filed: Dec. 6, 2001

(65) Prior Publication Data

US 2002/0066461 A1 Jun. 6, 2002

Related U.S. Application Data

(60) Provisional application No. 60/251,956, filed on Dec. 6, 2000.

(51) Int. Cl.[7] ..... A45D 9/00
(52) U.S. Cl. ..... 132/201; 132/73
(58) Field of Search ..... 132/73, 73.5, 201; 424/61, 401; 427/155

(56) References Cited

U.S. PATENT DOCUMENTS

| | | | | | |
|---|---|---|---|---|---|
| 4,104,133 | A | | 8/1978 | Brannan et al. | 204/25 |
| 4,104,333 | A | | 8/1978 | Lee, Jr. et al. | 260/885 |
| 4,299,243 | A | * | 11/1981 | Umstattd | 132/73 |
| 4,626,428 | A | | 12/1986 | Weisberg et al. | 424/61 |
| 4,646,765 | A | * | 3/1987 | Cooper et al. | 132/73 |
| 4,669,491 | A | | 6/1987 | Weisberg et al. | 132/73 |
| 4,687,827 | A | | 8/1987 | Russo | 427/340 |
| 4,708,866 | A | | 11/1987 | Turco et al. | 424/61 |
| 4,708,877 | A | | 11/1987 | Donovan et al. | 426/69 |
| 4,766,005 | A | | 8/1988 | Montgomery et al. | 427/4 |
| 4,798,720 | A | | 1/1989 | Holder | 424/61 |
| 4,844,102 | A | | 7/1989 | Repensek et al. | 132/73 |
| 4,873,077 | A | | 10/1989 | Thompson et al. | 424/61 |
| 5,127,414 | A | * | 7/1992 | Mast et al. | 132/73 |
| 5,650,138 | A | | 7/1997 | Resler | 424/61 |
| 5,770,184 | A | | 6/1998 | Keller | 424/61 |
| 5,785,959 | A | | 7/1998 | Wolfe et al. | 424/61 |
| 5,830,442 | A | | 11/1998 | Beaver | 424/61 |
| 5,866,106 | A | | 2/1999 | Papay | 424/61 |
| 5,886,106 | A | | 3/1999 | Sumner et al. | 515/332.8 |
| 5,897,853 | A | | 4/1999 | Unser | 424/61 |
| 6,270,751 | B1 | * | 8/2001 | Resler | 424/61 |

* cited by examiner

*Primary Examiner*—John J. Wilson
*Assistant Examiner*—Robyn Kieu Doan
(74) *Attorney, Agent, or Firm*—Cislo & Thomas LLP

(57) ABSTRACT

A method for producing colored nails without using nail polish is provided. According to a preferred embodiment, a nail brush is dipped into a resin, liquid adhesive, or nail hardening agent, and then into a colored acrylic powder, and the nail is then brushed with the mixture to form a coat. The coat is both quick to apply and quick to dry, and results in strong, chip-resistant, shiny colored nails. The coat produced can remain unchipped and/or unpealed for several weeks or longer.

14 Claims, 1 Drawing Sheet

METHOD AND SYSTEM TO POLISH AND PROTECT NATURAL NAILS

CROSS-REFERENCES TO RELATED APPLICATIONS

This patent application is related to and claims priority from U.S. Provisional Patent Application Ser. No. 60/251,956 filed Dec. 6, 2000 for METHOD AND SYSTEM TO POLISH AND PROTECT NATURAL NAILS.

BACKGROUND OF THE INVENTION

1. Field of the Invention

This invention relates generally to the field of manicuring. More specifically, this invention applies to nail care products and processes for treating nails.

2. Description of the Related Art

There are various methods and products for treating nails in order to enhance the aesthetic appearance of the nails. These include methods and products for coloring, hardening, and polishing the nails.

Conventional methods for treating the nails to achieve nail color and shine include applying colored nail polish. The application of nail polish is time consuming, as the nail polish often requires time to dry. Usually, the person having her nails treated has to sit still and refrain from using her hands until the nails dry, since accidental contact of any one of the nails with any object may cause the freshly applied color to smear. Various techniques have been used to accelerate the time required for drying the nails after nail polish has been applied. One such technique involves placing the hand under a nail dryer which blows air on the nail. Another technique involves applying a quick dry nail polish product to the nail after the nail polish has been applied. Additionally, nail polishes themselves may be formulated with a drying agent.

While using one or a combination of these conventional methods does reduce the time required for drying, it may still take about 10 minutes or longer for the nails to fully dry, depending on the thickness of the nail polish coat. Oftentimes, the nails only dry on the surface, and take much longer to completely harden, leaving the fresh coat susceptible to smearing for several hours after application.

Additionally, nail polish typically includes chemicals which exude potentially toxic fumes. A further major disadvantage of nail polish is that even if the coat applied does dry properly, it typically chips or peels within a day or two.

Other nail treatments involve hardening and/or strengthening the nails in order to reduce the chance of the nail chipping or breaking, which can be achieved by applying at least one coat of a hardening agent to the nail. There are many conventionally available hardening agents available on the market. One type of hardening agent which has a quick drying time is resin. While applying such hardening agent to the nail is not as time consuming as applying nail polish, typically, a person having her nails done also wants her nails to be colored. Since hardening agents are clear, a coat of nail polish is usually applied over the hardening agent. This results in the same problems of having to wait for the nails to dry, and susceptibility to smearing, as described above.

A recent technique for achieving color without nail polish involves sprinkling a pre colored acrylic polymer powder on top of a wet coat of nail hardener, or dipping a nail coated with resin into the powder. The powder then has to be smoothed onto the surface of the nail in order to achieve a uniform coat. Thus additional steps, such as applying another coat of adhesive, applying a coat of oil, and even applying a coat of clear nail polish, are required. Thus, this method may still be as time consuming as applying nail polish, as well as labor consuming.

SUMMARY OF THE INVENTION

The present invention provides a quick process for coloring nails without using nail polish. According to a preferred embodiment, a nail brush is dipped into a resin, liquid adhesive, or nail hardening agent, and then into a colored powder, and the nail is then brushed with the mixture to form a coat. The coat is both quick to apply and quick to dry, and results in strong, chip-resistant, shiny colored nails. The coat produced can remain unchipped and/or unpealed for several weeks or longer, and protect the natural nail from breaking.

OBJECTS OF THE INVENTION

It is an object of the present invention to provide a quick polish-free method for coloring nails which does not require a long amount of drying time.

It is another object of the present invention to provide a polish free method for coloring nails which results in a strong chip resistant protective shield for nails.

It is yet another object of the present invention to provide a polish free method for coloring nails which results in a smudge resistant, chip resistant and/or peel resistant color coat.

These and other objects and advantages of the present invention will be apparent from a review of the following specification and accompanying drawings.

DESCRIPTION OF THE PREFERRED EMBODIMENT(S)

Figure 1:
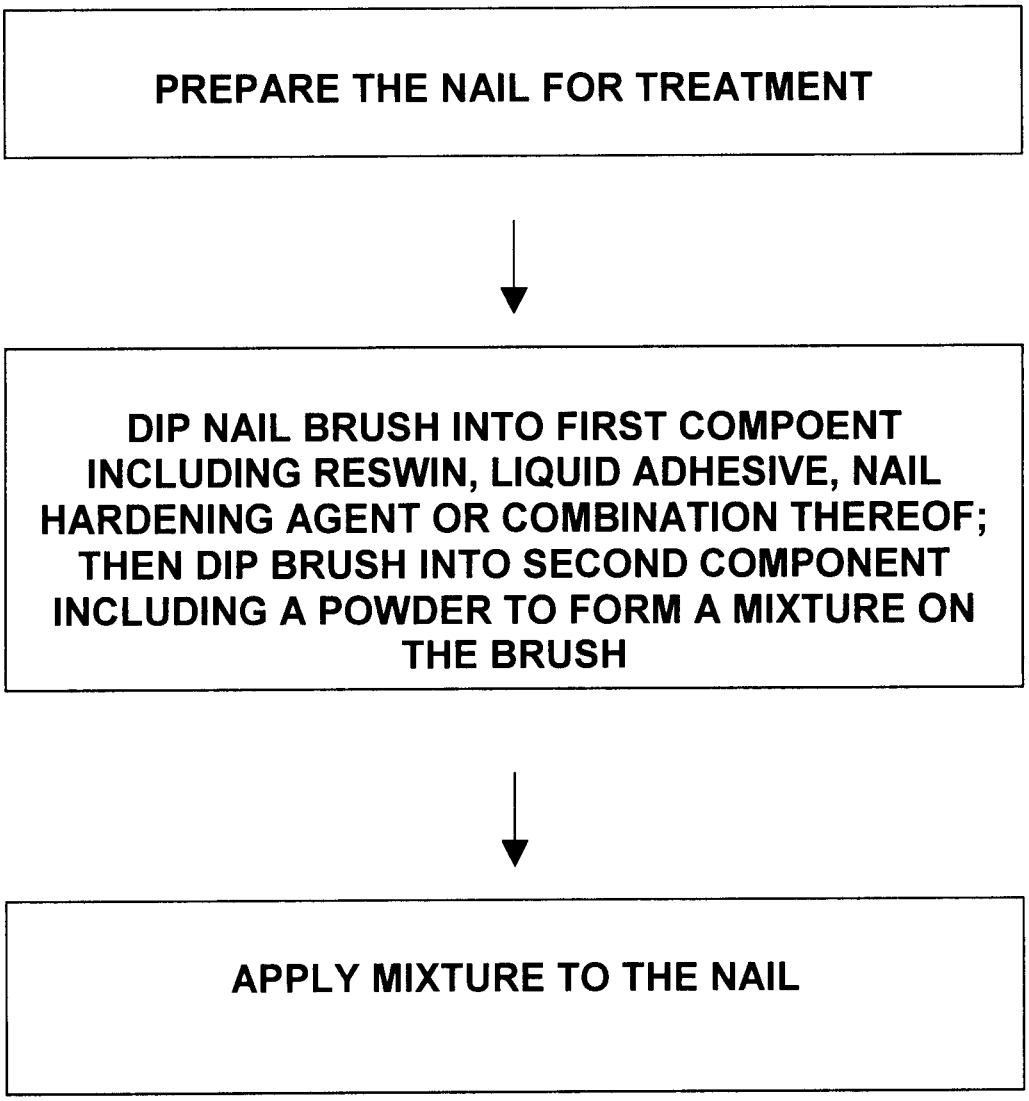
FIG. 1 is a flow chart showing the general steps for treating nails according to a preferred embodiment of the present invention.

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

A general method for treating a finger nail according to a preferred embodiment of the present invention, as outlined in FIG. 1, comprises the steps of 1) preparing the nail for treatment by removal of old nail polish, dirt particles, natural nail shine, etc., 2) dipping a nail brush into a first component which includes a resin, liquid adhesive, nail hardening agent (also known as a strengthening or protective agent), or combination thereof, and then dipping the same brush into a second component, which includes a powder, to form a mixture on the brush, and 3) applying the mixture to the nail.

Preparation of the nail for treatment may be done by any conventional means according to the preferences of the manicurist and/or person being treated. For best results, it is generally preferable for the nail to be clean, and free from any prior nail polish or the natural top coat of the nail, dirt, water, etc. before treatment. Steps for preparing the nail may include filing or gently buffing the superficial layer of oil, dirt, and/or shine from the natural nail. This can be done by using a file, preferably a soft grit file such as a 600 grit. The hands may also be washed, preferably with an antibacterial soap. Thereafter a dehydrator and/or cleanser may be applied, for example by spraying, to the user's nails. The cuticle of the nail may also be pushed back with a file and/or orangewood stick.

The resin, liquid adhesive, or nail hardening agent into which the brush is dipped is preferably a cyanoacrylate. Suitable cyanoacrylates may include 2-alkyl cyanoacrylates, wherein the alkyl group is preferably a methyl or ethyl group, but may also be n-propyl, isopropyl, n-butyl, or isobutyl. However, the cyanoacrylate is not limited to alkyl cyanoacrylate. It is to be understood that the brush may be dipped into any resin, adhesive or glue, nail hardening agent or product containing the same, which may be in gel, liquid or otherwise semi-solid form. Resin, glues or adhesives, or other products which may not be typically used as nail hardening agents, or have not yet been discovered for their use as such agents may also be used.

After dipping the brush into the first component, the brush is soon after dipped into a colored powder, such as a powdered acrylic or a pure pigment powder. The powder may contain an accelerator, also known as an activator, initiator, or catalyst, which speeds up the drying time by causing the composition to cure in situ on the surface of the nail. However, it may be desirable to use a powder which does not contain an accelerator, to prevent the solution from drying before being fully applied to the nail. Drying time may range from a few seconds to over a minute depending on the substances used, the viscosity of the first substance, and on whether or not an activator is included. Typically, a higher the viscosity yields a slower the drying time.

According to a preferred embodiment, the powder is a pre-colored acrylic polymer which contains a polymerized lower alkylmethacrylate such as polymethylmethacrylate and/or an acrylic ester polymer and may also contain titanium dioxide. A suitable accelerator which may be included in the powder, can be a peroxide, such as lauroyl peroxide or benzoyl peroxide, and/or include a base, having an OH group, or amine compound, but is not limited to these examples.

When the first and second substances, according to the preferred embodiment, are brought into contact, a liquid is formed which can be brushed onto the nail as traditional nail polish would. This result is unexpected as evidenced by the prior art technique of first applying resin to the nail, then sprinkling or dipping the finger in the powder. One of ordinary skill in the art would likely presume that mixing the two substances outside the nail would result in the brush hardening with the powder forming a thick gluey mess. Surprisingly, the mixture smoothly brushes onto the nail like traditional nail polish. Additionally, the mixture can usually be easily removed from the brush, by wiping it off the brush. Use of a slower setting cyanoacrylate may improve the ease at which the mixture can be removed. However, if the mixture does stick to the brush, for example, after having been left for a prolonged period of time on the brush, the brush can be cleaned with acetone.

The brush used to apply the mixture is preferably very thin, however, any type of brush may be used. Although using a brush is preferred, any type of application method is contemplated. For example, a regular cloth, sponge, or other suitable application medium could be used instead of a brush. Additionally, the two components could be mixed on a suitable pallet, in a bowl, small dish, etc. This method could be used to create a large amount of mixture, enough for painting 10 fingernails, rather then creating enough mixture for just one nail at a time. However, since such a mixture would tend to harden quickly, in order to ensure that the mixture does not harden until applied to the nail, the resin, adhesive, or hardening agent would preferably be slow to cure, and no activator or quick drying agent would be included in the powder or otherwise in the mixture.

According to the preferred embodiment, the first component, which includes the resin, liquid adhesive, or nail hardening agent, is clear, while the powder is colored, however, both components may be clear. Additionally, the first component may be pre-colored. In order to achieve a desired color, a pigment comprising any type of dye or colorant could be added to the first component. In this case it may not be necessary to add the powder in order to achieve the color desired, however, the powder may be added if desired, according to the method described.

Various optional steps may be added to the method of FIG. 1. These include, but are not limited to, applying a coat of the first component to the nail prior to applying the mixture coat, applying an accelerator or any quick dry product to the mixture coat, buffing the nail, applying further coats of the first component or coats of the mixture as desired.

An accelerator or quick dry product (for example from silk or fiberglass nail systems) can be applied to accelerate the drying time. Various techniques for applying the accelerator or quick dry product include brushing, spraying on with a pump or aerosol, dropping on the nail, or dipping the nail into the activator. Preferably, as the nail begins to look a little dull, an accelerator is sprayed on. According to the preferred embodiment the accelerator or quick dry product contains Acetone, Ethyl Acetate, Gamma Butro/actone, and NN Dimethyl-P-Toluidine. This should be sprayed from a distance between 8 to 12 inches. Additionally, the nails may dry on without use of an accelerator or quick dry product.

After the nail has dried, the nail may be buffed preferably with soft buffer to smooth the nail, then buffed to a glossy shine or a top coat can be added for a glossy shine. However, it may not be necessary to buff, since the nail can dry shiny after using the accelerator. A variety of such additional steps may be used depending on the preferences of the manicurist and/or individual receiving the manicure.

This method may further be used with one or more pre-colored or clear powder to create nail art, color layering, or a French manicure look. As described above, the first component may also be pigmented to create any desired result. Additionally, the method could be used in conjunction with any nail extensions.

While the present invention has been described with regards to particular embodiments, it is recognized that additional variations of the present invention may be devised without departing from the inventive concept.

What is claimed is:

1. A method for treating a nail, comprising:

(a) dipping an applicator into a first component wherein the first component is a liquid resin, adhesive, nail hardening agent, or a combination thereof;

(b) dipping the applicator having the first component thereon into a powder component having a desirable appearance and texture to form a heterogeneous mixture of said first component and said powder component; and (c) applying the heterogeneous mixture to the nail, wherein a generally homogeneous appearance upon the application of said heterogeneous mixture is achieved upon a surface of the nail.

2. The method of claim 1 wherein said first component comprises a cyanoacrylate.

3. The method of claim 2 wherein said cyanoacrylate is an alkyl cyanoacrylate.

4. The method of claim 1 wherein said first component is either clear or colored.

5. The method of claim 1 wherein said powder component is either clear or colored.

6. The method of claim 1 wherein said powder component is a powdered acrylic.

7. The method of claim 1 wherein said powder component is a pigment powder.

8. The method of claim 1 wherein said powder component further comprises an accelerator.

9. The method of claim 8 wherein the accelerator is benzoyl peroxide.

10. The method of claim 9 further comprising the step of preparing the nail for treatment prior to applying the mixture to the nail.

11. The method of claim 1, further comprising (d) applying an accelerator or quick dry agent to the nail.

12. The method of claim 11 further comprising (e) buffing the nail.

13. The method of claim 1 wherein said powder component further comprises a dye or a colorant.

14. The method of claim 1 wherein said powder component further comprises a dye or a colorant.

* * * * *